US011359781B2

(12) United States Patent
McMillan

(10) Patent No.: US 11,359,781 B2
(45) Date of Patent: Jun. 14, 2022

(54) STREET LIGHT WITH NECK CUFF

(71) Applicant: George Erik McMillan, Hickory, NC (US)

(72) Inventor: George Erik McMillan, Hickory, NC (US)

(73) Assignee: Epic Universal Technologies, LLC, Hickory, NC (US)

( * ) Notice: Subject to any disclaimer, the term of this patent is extended or adjusted under 35 U.S.C. 154(b) by 25 days.

(21) Appl. No.: 16/915,581

(22) Filed: Jun. 29, 2020

(65) Prior Publication Data

US 2020/0408372 A1 Dec. 31, 2020

Related U.S. Application Data

(60) Provisional application No. 62/868,495, filed on Jun. 28, 2019.

(51) Int. Cl.

| | |
|---|---|
| ***F21S 8/08*** | (2006.01) |
| ***F21W 131/103*** | (2006.01) |
| ***F21Y 115/10*** | (2016.01) |
| ***F21V 19/00*** | (2006.01) |

(52) U.S. Cl.

CPC ..... *F21S 8/085* (2013.01); *F21S 8/086* (2013.01); *F21V 19/0035* (2013.01); *F21W 2131/103* (2013.01); *F21Y 2115/10* (2016.08)

(58) Field of Classification Search

CPC .. F21S 8/085; F21S 8/086; F21S 8/088; F21S 13/10; F21W 2131/103; F21V 19/004; F21V 19/0035

USPC ..... 362/657, 658, 659, 652, 647, 640, 431

See application file for complete search history.

(56) References Cited

U.S. PATENT DOCUMENTS

| | | | | |
|---|---|---|---|---|
| 4,639,843 | A * | 1/1987 | Compton | F21S 8/086 362/431 |
| 5,257,172 | A * | 10/1993 | Erickson | F21L 14/02 362/457 |
| 6,183,112 | B1 * | 2/2001 | Bomas | F21S 8/083 362/153 |
| 7,723,862 | B1 * | 5/2010 | Spillman | H05B 47/11 307/12 |
| 2005/0207179 | A1 * | 9/2005 | Pan | F21V 23/0407 362/654 |
| 2016/0053952 | A1 * | 2/2016 | Kuti | F21V 29/70 362/311.02 |

* cited by examiner

*Primary Examiner* — Laura K Tso

(74) *Attorney, Agent, or Firm* — Travis Lee Johnson; Ascentage Patent Law

(57) ABSTRACT

In one aspect, a light fixture assembly configured for exterior lighting includes a light fixture. The light fixture includes an LED light source configured for exterior lighting, a driver configured to power the light source and a first electrical connector coupled to the driver. The light fixture also includes a housing to house the LED light source and the driver, where the housing includes an elongated extension on which the first electrical connector resides. The light fixture assembly also includes a neck cuff that fits securely to a light pole. The neck cuff includes a second electrical connector inside that is connected to a power source in the light pole. The extension of the light fixture is configured to be inserted into the neck cuff such that the first electrical connector of the light fixture removably connects to the second electrical connector of the neck cuff.

18 Claims, 9 Drawing Sheets

STREET LIGHT WITH NECK CUFF

RELATED APPLICATIONS

This application claims the benefit of U.S. Provisional Patent Application No. 62/868,495 filed on Jun. 28, 2019; which is herein incorporated by reference in entirety.

TECHNICAL FIELD

The present invention generally relates to exterior light fixtures, and particularly relates to the installation and replacement of exterior lights, such as street lights.

BACKGROUND

Street lights are beneficial, but if large in number, repair or replacement of the street lights can be costly for a town or municipality. To replace a street light, due to failure or upgrade, a light technician has to rewire the connection to the light. This may involve handling a heavy light fixture above traffic while disconnecting and reconnecting live wires. FIG. 1 shows an example of a cobra head street light fixture 20 on light pole 10. FIG. 2 shows the internal wiring 30 of the light pole 10 and the wiring 32 of the light fixture 20 that must be connected while the technician manages the weight of the street light fixture. Current methods of street light replacement can be expensive and possibly dangerous.

SUMMARY

Embodiments of the present invention include a light fixture with a neck cuff that simplifies exterior light replacement while improving the safety of the technician. The neck cuff may be a whole or partial tube that fits within (and/or partially slides over) the light pole. The electrical connector is deep inside the neck cuff and the electrical connector of the light fixture is on an extension that inserts into the neck cuff. When the extension of the light fixture is inserted into the neck cuff, the electrical connector of the neck cuff plugs into the electrical connector of the light fixture. Future replacements of the light fixture will not require the technician to handle any wiring inside the light fixture while atop the light pole. The technician just has to unsecure (unclip or unscrew) the old light fixture, pull it out of the neck cuff, insert the extension of the new light fixture into the neck cuff and secure the new light fixture (screw or clip). Another benefit is that any components in the old light fixture can be replaced under safer circumstances (on the ground or at another location), and the upgraded light fixture can then be inserted into another neck cuff in another light pole. Furthermore, because the live electrical connector is deep inside the neck cuff, the technician is less likely to come into contact with any live wire during light fixture removal and replacement.

According to some embodiments, a light fixture assembly configured for exterior lighting includes a light fixture that includes: a Light-Emitting Diode (LED) light source configured for exterior lighting, a driver configured to power the LED light source, a first electrical connector coupled to the driver and a housing configured to house the LED light source and the driver. The housing includes an elongated extension on which the first electrical connector resides. The light fixture assembly also includes a neck cuff, where the neck cuff is configured to fit securely to a light pole, such as at the open, wired end of the light pole. The neck cuff includes a second electrical connector inside the neck cuff, the second electrical connector is configured to electrically connect to a power source in the light pole. The extension of the light fixture is configured to be inserted into the neck cuff such that the first electrical connector of the light fixture removably connects to the second electrical connector of the neck cuff, as the light fixture is secured in place onto the light pole.

According to some embodiments, a light fixture includes an LED light source configured for exterior lighting, a driver configured to power the LED light source, a first electrical connector coupled to the driver and a housing configured to house the LED light source and the driver. The housing includes an extension on which the first electrical connector resides, and the extension is an elongated portion that is configured to insert into a neck cuff secured inside or onto a light pole. The neck cuff includes a second electrical connector inside the neck cuff, electrically connected to a power source in the light pole. The extension of the light fixture is configured to be inserted into the neck cuff such that the first electrical connector of the light fixture removably connects to the second electrical connector of the neck cuff, and the extension is configured to be secured to the neck cuff.

According to some embodiments, a method of replacing an old light fixture with a new light fixture, where each of the old and new light fixtures includes an LED light source configured for exterior lighting and an elongated extension on which a first electrical connector resides, includes unsecuring the extension of the old light fixture from a neck cuff secured to a light pole, where the neck cuff comprises a second electrical connector down inside the neck cuff, electrically connected to a power source in the light pole and removably connected to the first electrical connector on the extension of the old light fixture. The method includes removing the extension of the old light fixture from inside the neck cuff, causing the first electrical connector of the old light fixture to disconnect from the second electrical connector of the neck cuff. The method also includes inserting the extension of the new light fixture into the neck cuff until the first electrical connector of the new light fixture forms an electrical connection with the second electrical connector of the neck cuff. The method further includes securing the extension of the new light fixture to the neck cuff.

In another embodiment, a neck cuff having a mostly hollow and cylindrical-shaped body portion has a quick connect electrical connector disposed within the hollow body at 2 inches are greater distance from an opening on one end of the body meant for attaching to a light assembly. A latching mechanism is formed about the body and configured to secure a light assembly to the neck cuff when the light assembly is inserted into the opening of the neck cuff. The quick connect electrical connector of the neck is configured to receive a corresponding quick connect electrical connector of the light assembly.

The latching mechanism of the neck cuff can further include a pin about which the latching mechanism pivots, a spring disposed between a sidewall of the body and the latching mechanism to keep the latching mechanism in a closed position until a part of a lever of the latching mechanism is depressed which releases the component that it is attached or latched to.

The body of the neck can include a guide disposed on another sidewall of the body, which is helpful to align the light assembly being inserted therein, such that the quick connect electrical connectors of the neck and light assembly are lined up to be inserted accordingly.

Of course, the present invention is not limited to the above features and advantages. Those of ordinary skill in the art will recognize additional features and advantages upon reading the following detailed description, and upon viewing the accompanying drawings.

DETAILED DESCRIPTION

Embodiments of the present invention are directed to a light fixture for exterior lighting, such as a street light, that is easier and safer to replace. This new light fixture has a neck cuff that simplifies exterior light replacement while improving the safety for the technician. The neck cuff may be a whole or partial tube that fits within (or slides over) the end of the exterior light pole. The electrical connector will be deep inside the neck cuff.

Figure 1:
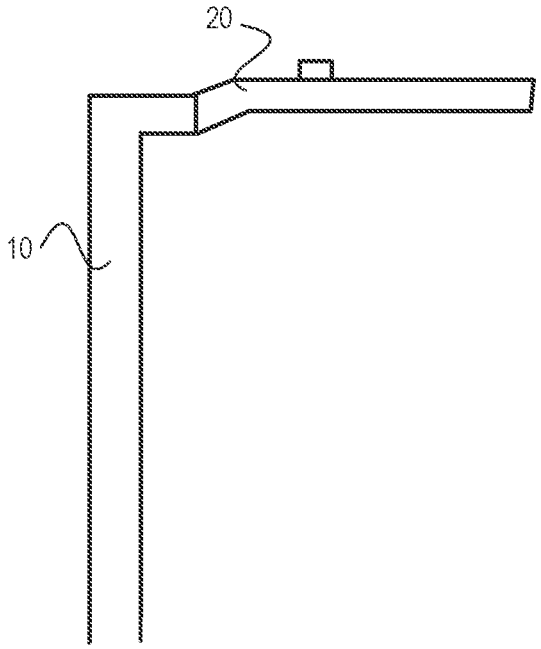
FIG. 1 (Prior Art)
FIG. 1 illustrates a cobra head street light.
Figure 2:
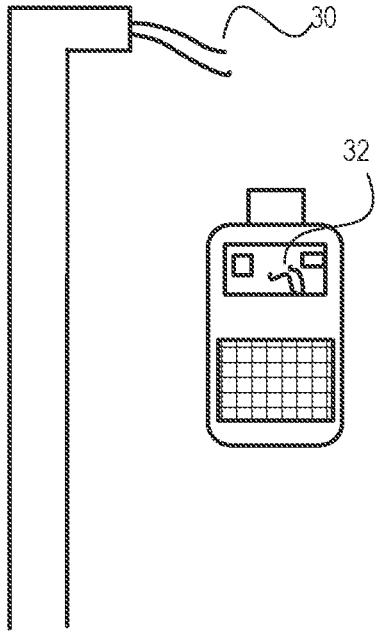
FIG. 2 (Prior Art)
FIG. 2 illustrates a disconnected street light with the internal wiring.
Figure 3:
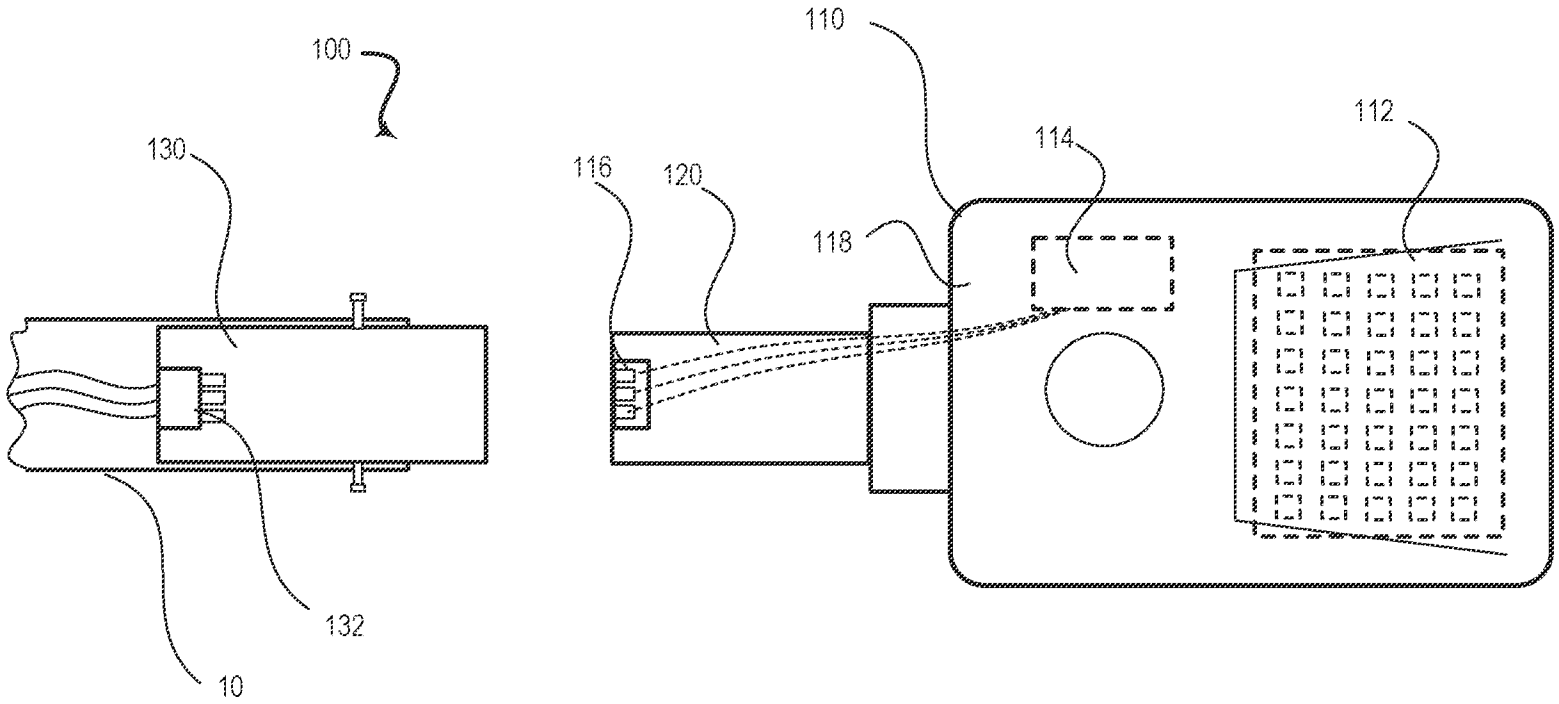
FIG. 3 illustrates an exterior lighting assembly, according to some embodiments.

FIG. 3 illustrates an example of a light fixture for exterior lighting, such as a street light, according to an embodiment. The street light includes a light assembly 100 of at least two parts, a light fixture 110 and a neck cuff 130. Light fixture 110 contains a light source 112, which may be made up one or more arrays of Light-Emitting Diodes (LEDs). The LEDs, or other lighting components, are configured for exterior lighting. That is, their arrangement and selection is such that the output is consistent with the lighting required for exterior lighting, whether it is a street, a path or a sidewalk. While street lights are described in the examples, the exterior lighting may also be configured for stadium lighting, field lighting, airport lighting or path lighting.

Light fixture 110 includes a driver 114 and other controls that are configured to power LED light source 112. Light fixture 110 further includes a first electrical connector 116 coupled to driver 114. Light fixture 110 includes a housing 118 configured to house LED light source 112 and driver 112, where housing 118 includes an extension 120 on which first electrical connector 116 resides.

Neck cuff 130 may be a tube that is formed with a circumference or perimeter that fits just inside the inner circumference or perimeter of light pole 10 or slides over the outer circumference or perimeter of pole 10. Neck cuff 130 may have a split along its length to allow for size adjustments or for fitting just within or over light pole 10. Neck cuff 130 is configured to fit securely within or over light pole 10 with screws or other fastening members. Neck cuff 130 may be a cylindrical tube, a rectangular tube or another shape that is long and at least partially hollow so as to receive extension 120 and make an electrical connection within neck cuff 130.

Second electrical connector 132 is configured to electrically connect to a power source via an electrical connection in light pole 10. Neck cuff 130 is long enough such that second electrical connector 132 resides deep inside neck cuff 130, deep enough that a technician's fingers cannot so easily brush second electrical connector 132 during light fixture replacement. For example, second electrical connector 132 may be at least four inches from an opening of neck cuff 130. In other variations, the distance could be 2 inches, 3 inches, 5 inches or 6 inches.

Figure 4:
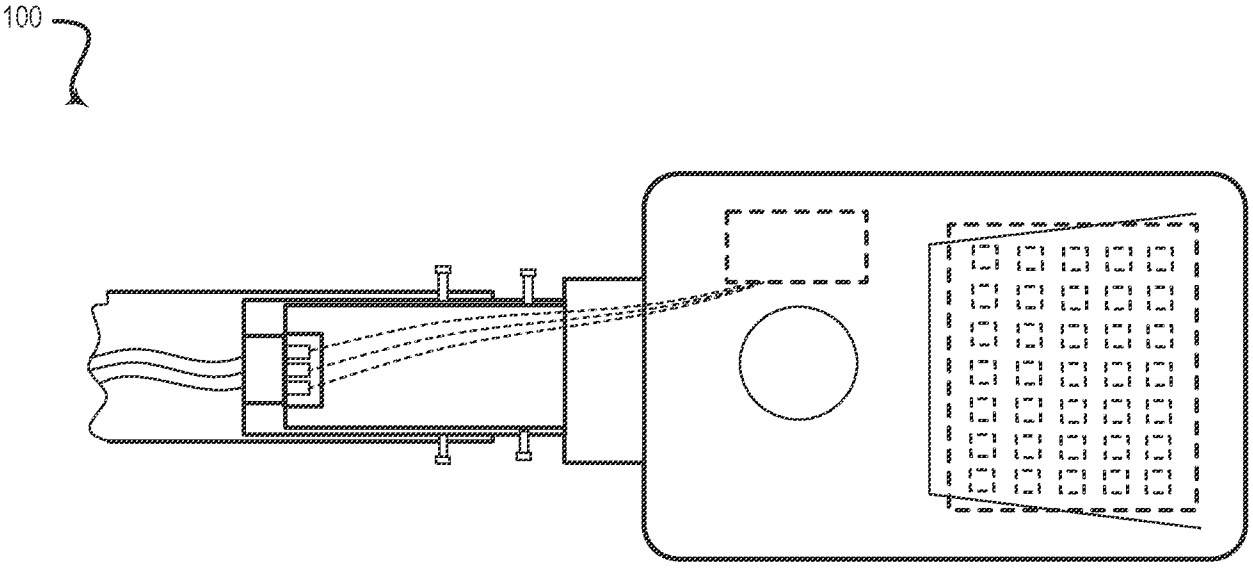
FIG. 4 illustrates an exterior lighting assembly where the extension of the light fixture is inserted into the neck cuff, according to some embodiments.
Figure 5:
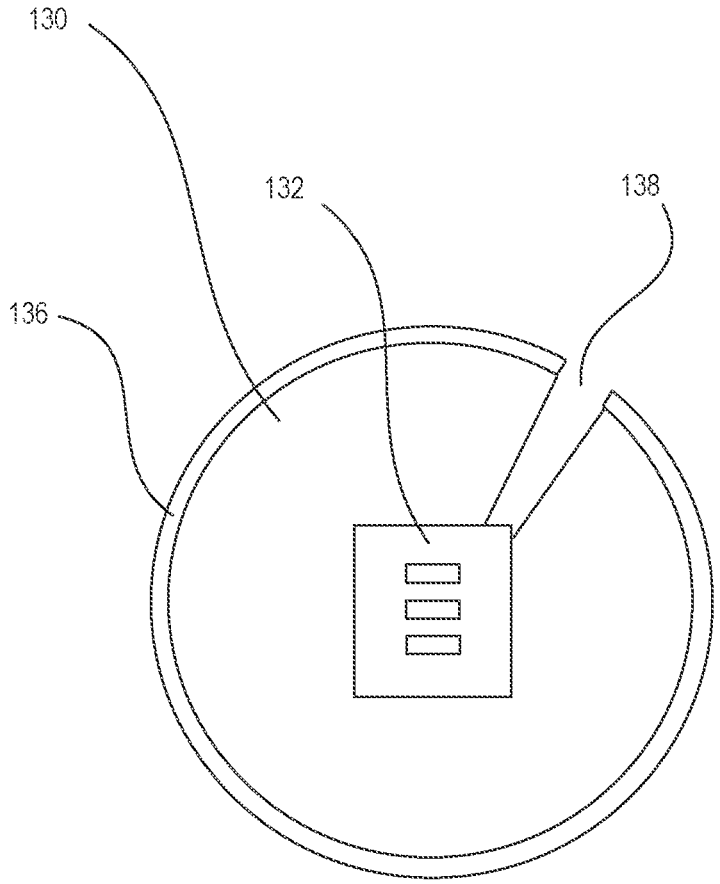
FIG. 5 illustrates a top view of the neck cuff, according to some embodiments.

Extension 120 of light fixture 110 is configured to be inserted into neck cuff 130 such that second electrical connector 132 (male) of neck cuff 130 removably plugs into first electrical connector 116 (female) of extension 120. Extension 120 is secured to neck cuff 130 by screws, clips or other by other fasteners. FIG. 4 is an illustration of when extension 120 of light fixture 110 is inserted into neck cuff 130, according to some embodiments.

Figure 6:
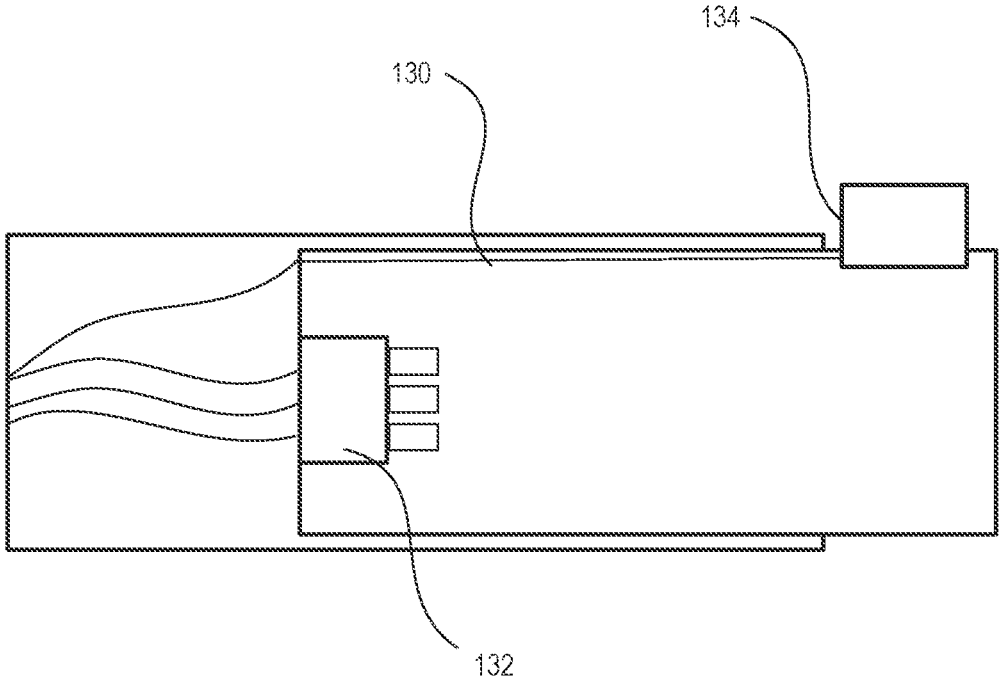
FIG. 6 illustrates a neck cuff with a receptacle or port for other exterior lighting, according to some embodiments.

FIG. 6 illustrates a top view of one version of a neck cuff, according to some embodiments. Neck cuff 130 has a tube 136 or other perimeter that may have a complete circumference or it may have a split 138 for size or fitting adjustments. Second electrical connector 132 is shown in neck cuff 130. In some embodiments, tube 136 may have a lip or portion that curves over the end of pole 10 and onto the outside of tube 136. In some embodiments, neck cuff 130 may have a ridge and/or a slightly enlarged portion that allows neck cuff 130 to slide in and fit snugly within light pole 10. In other embodiments, other structures may be used to stabilize and secure neck cuff 130 inside and/or to light pole 10.

FIG. 6 also illustrates an example of an electrical outlet, receptacle or port 134 on neck cuff 130 that electrically connects to second electrical connector 132 (e.g., 5 ports rather than 3 ports) and provides power to another light fixture, such as a holiday light display or a string of seasonal lights. Outlet 134 may be a National Electrical Manufacturers Association (NEMA) plug and/or may have a weather cover that can be tethered to neck cuff 130. Instead of having to open light fixture 110 and connect the seasonal light display to a power wire in light fixture 110, the seasonal light display may be plugged into outlet or port 134. The outlet 134 may be provided at any location on the neck cuff. While the use of an LED light source is described in the examples herein, other light sources may be used.

Figure 7A:
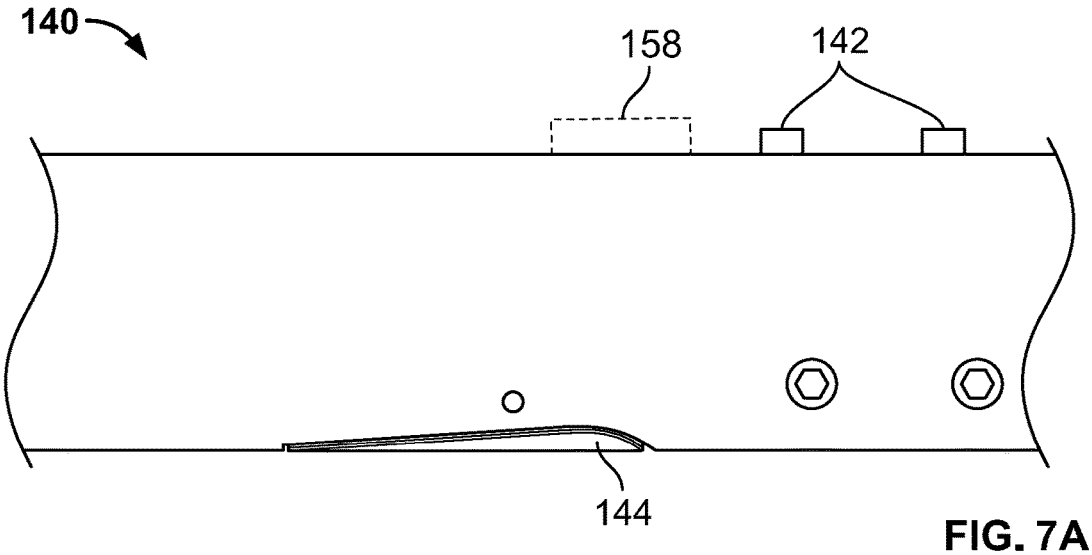
FIGS. 7A-C illustrate another embodiment of a neck cuff.

FIG. 7A illustrates another embodiment of a neck cuff 140. The neck cuff 140 may be attached to a streetlight pole utilizing attachment members 142. Attachment members 142 may be screws, bolts, press-fit clips, or any other device suitable to secure the neck cuff 140 to the streetlight pole. The neck cuff 140 includes a latching mechanism 144 that is configured to secure an extension of a light assembly to the neck cuff 144. An optional electrical outlet 158 may be provided on an exterior portion of the neck cuff to allow other devices to be powered by streetlight power supply without requiring access to the interior of the streetlight pole.

Figure 7B:
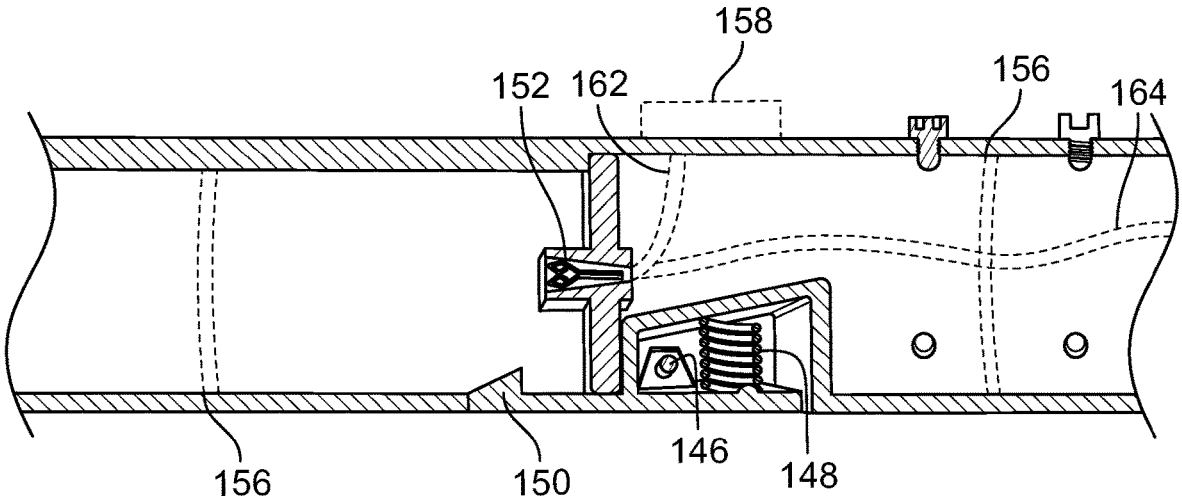

FIG. 7B illustrates a cross-section view of the neck cuff 140 shown in FIG. 7A. The latching mechanism 144 is mounted on a pin 146 and pivots between a closed position (shown in FIGS. 7A-C) and an open position. The pin 146 is mounted to the neck cuff and spring 148 pushes the latching mechanism to the closed position. The latching mechanism includes a protrusion 150 for securely fitting into the neck 144 and the extension of the light assembly. A quick connect electrical connector 152 is located at an interior location of the neck cuff and is connected to internal wiring of the streetlight. One or more sealing members 156 may be provided in different portions of the interior of the neck cuff in order to keep moisture, dirt, and insects from entering the interior of the neck cuff. For example, a sealing member 156 may be located near the attachment members 142 and a sealing member maybe located between the quick connect electrical connector 152 and an end of the neck cuff 140. In one embodiment, the optional sealing members 156 comprise one or more O-rings.

Figure 7C:
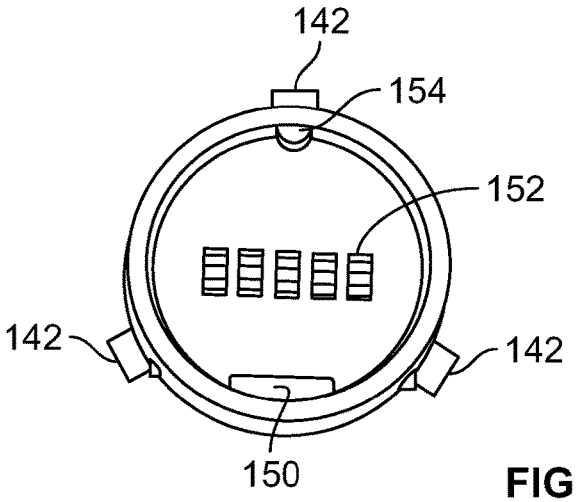

FIG. 7C illustrates a view of the interior of the neck cuff 140 on an end where the light assembly extension is inserted into the neck cuff 140. The interior of the neck cuff includes a guide member 154, which is a protrusion configured to properly orientate the extension when the extension is inserted into the neck cuff 140. The guide member 154 engages with an orientation feature 160 on the extension of the light fixture (shown in FIGS. 9A-10C). The orientation feature 160 of may be a notch, an indentation, or any other feature configured to engage with the guide member to ensure the electrical connector 116 of the extension will engage with quick connect electrical connector 152 of the neck cuff 140. The quick connect electrical connector 152 is configured to connect to an electrical connector of the light assembly when the extension is inserted into the neck cuff. The quick connect electrical connector 152 is shown with five contacts. Three of the five contacts provide power to a light fixture when a light fixture is installed in the neck cuff 140. In one variation the three of the five contacts are ground, neutral and lead or hot connections. Two of the contacts can be used to provide power to the optional electrical outlet 158 electrical line 162 or to provide a powered line that can be stored in the pole for access if additional power is needed. In another embodiment, the quick connect electrical connector 152 only includes three contacts that are configured to provide power to an installed light fixture. Power coming into the quick connect electrical can be from electrical line 164 that is connected directly to power or to a driver that is then connected to power.

It should be noted the return power via electrical line 162 into electrical outlet 158 can be previously converted by the driver, which is located within the light assembly or prior to the electrical line 164 as noted above. The return power can be converted to 12V or 24V DC, for example. By converting the power to 12V or 24V DC this makes the electrical outlet safer, as those plugging in temporary or seasonal features, such as Christmas lights, do not have to tie into the direct AC power of one of the internal lines.

Figure 8:
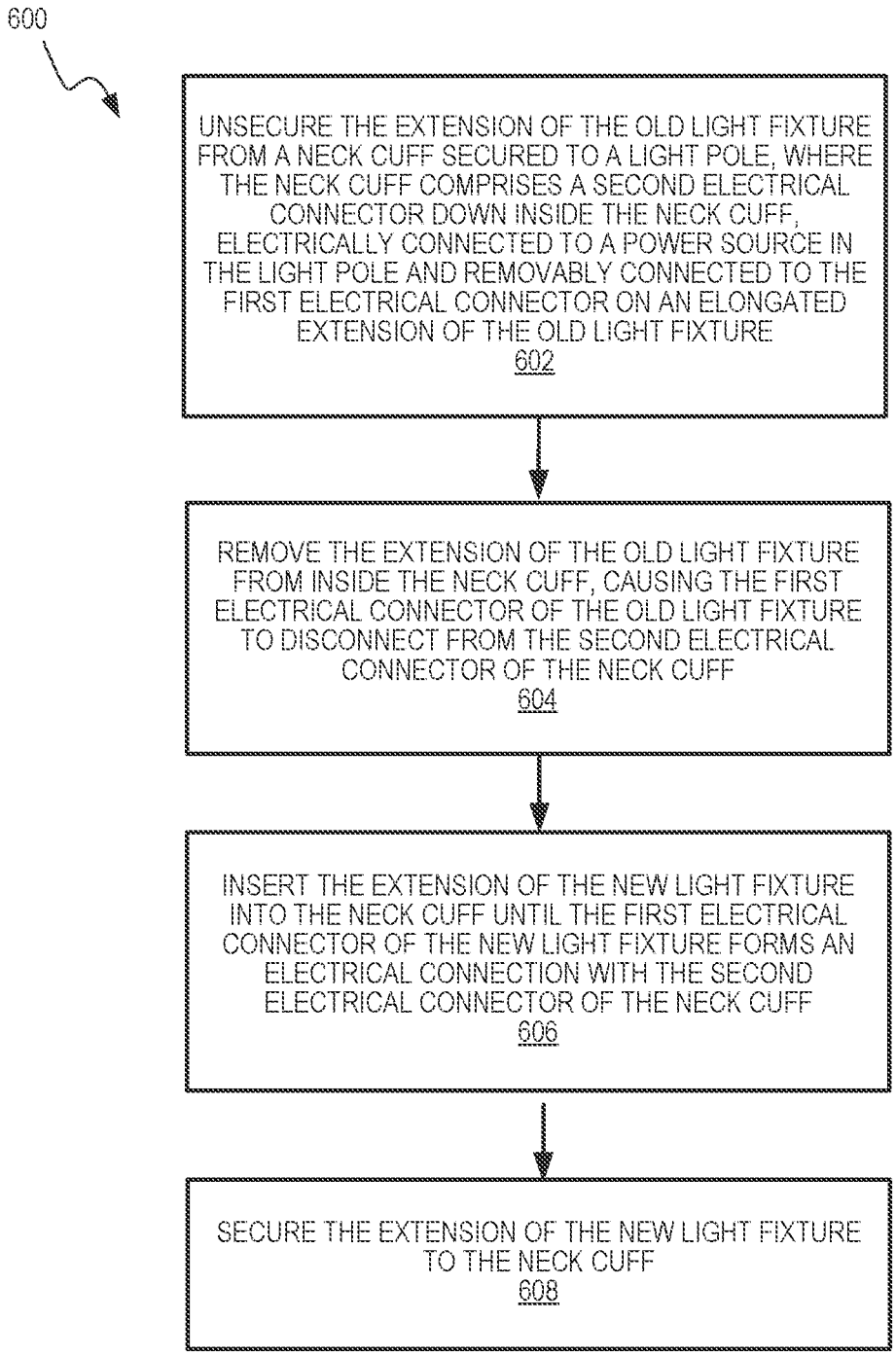
FIG. 8 illustrates an example method of replacing a light fixture using the neck cuff, as described in the embodiments.

FIG. 8 illustrates a flowchart of a method 600 that shows, according to an embodiment, the ease by which an old light fixture may be replaced by a new light fixture in the future, where each of the old and new light fixtures comprises an LED light source configured for exterior lighting and an elongated extension on which a first electrical connector resides. Method 600 includes unsecuring the extension of the old light fixture from a neck cuff secured to a light pole, where the neck cuff comprises a second electrical connector down inside the neck cuff, electrically connected to a power source in the light pole and removably connected to the first electrical connector on the extension of the old light fixture (block 602). Unsecuring may include unclipping, unscrewing, unbolting or otherwise preparing the old light fixture so that it can be removed from the neck cuff.

Method 600 also includes removing the extension of the old light fixture from inside the neck cuff, causing the first electrical connector of the old light fixture to disconnect from the second electrical connector of the neck cuff (block 604) and inserting the extension of the new light fixture into the neck cuff until the first electrical connector of the new light fixture forms an electrical connection with the second electrical connector of the neck cuff (block 606). The connection is formed by a male plug of an electrical connector forming a connection with a female receptacle of the other electrical connector. Method 600 then includes securing the extension of the new light fixture to the neck cuff (block 608). In some cases, there may be additional clips or fasteners for hurricane conditions.

As shown by method 600, an advantage of the light fixture assembly is that once the neck cuff is installed in or onto the end of the pole, the installation and replacement of the light fixtures is quick, safe and easy. The streetlight, stadium light or other exterior light does not need to be wired again.

In a further embodiment, the method can include plugging an electrical connector of another exterior light into a side of the neck cuff. This is a quicker way to connect seasonal lights or other exterior lighting, where it previously required opening the light fixture and accessing and connecting another wire.

In order to install the neck cuff of the embodiments described herein, the neck cuff is slid onto an existing pole. The installer connects the internal wiring of the streetlight to electrical connector of the neck cuff. In embodiments including an electrical outlet, the electrical is electrically connected to the electrical connector. Therefore, connecting the wiring to electrical connector also connects the outlet to the wiring and provides power to the electrical outlet. The installer also secures the neck cuff to the streetlight by using attachment devices, such as screws or bolts, to fixedly mount the neck cuff to the pole.

Figure 9A:
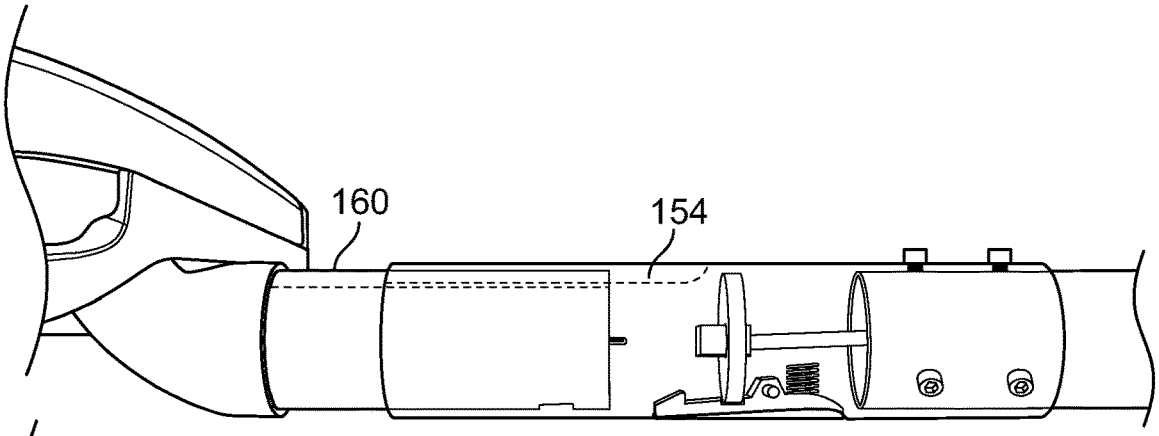
FIGS. 9A-D illustrate installing an exterior lighting assembly, according to some embodiments.
Figure 9B:
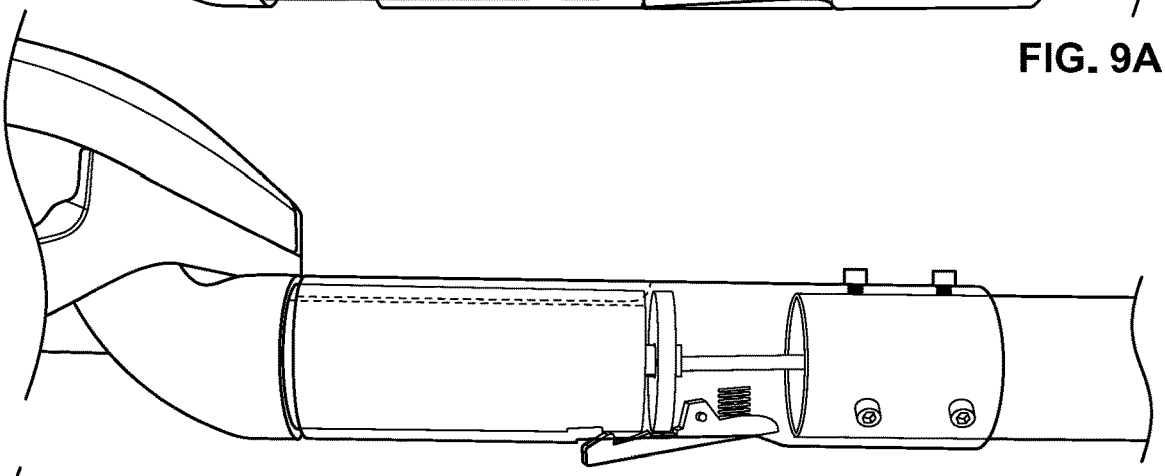
Figure 9C:
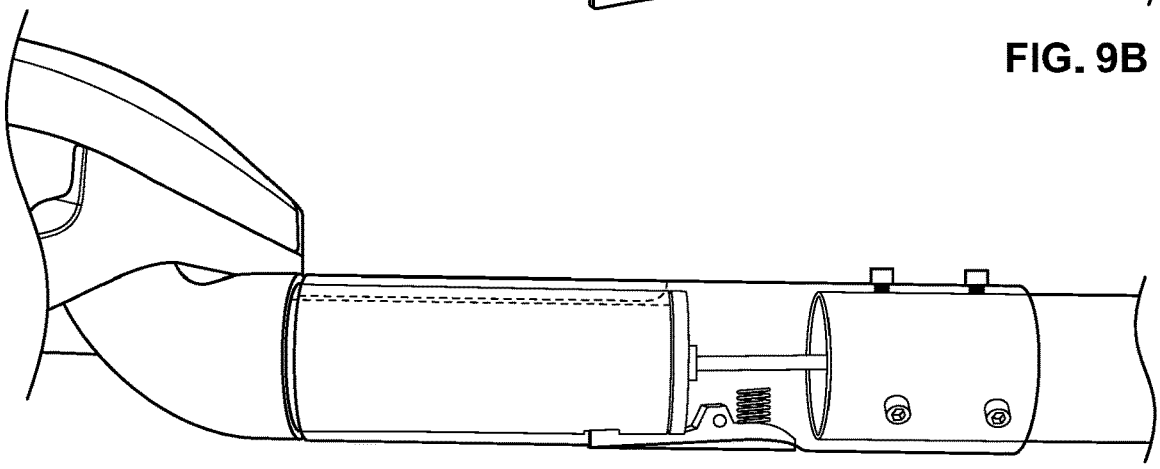
Figure 9D:
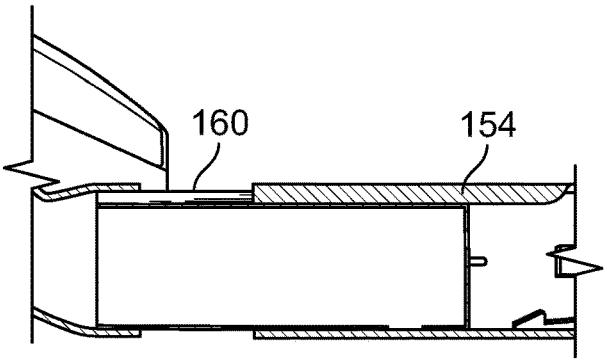

FIGS. 9A-C illustrate installing a light fixture assembly to a light pull that is fitted with a neck cuff as described above. In FIG. 9A, the extension of the light assembly is inserted into the neck cuff and the latching mechanism is in a closed position. As the extension is slid further into the neck cuff, eventually the extension contacts the protrusion of the latching mechanism causing the latching mechanism to move into an open position (see FIG. 9B). As the extension continues to be slid into the neck cuff, the electrical connector of the light assembly contacts and connects with the quick connect electrical connector of the street cuff and the latching mechanism returns to the closed position (see FIG. 9C). The light assembly is now electrically connected to the power source via the quick connect electrical connector and the latching mechanism prevents the light assembly from sliding out of the neck cuff. Thus, the light assembly is easily installed by merely sliding the extension into the cuff until the light assembly is locked into place by the interior features of the neck cuff and the latching mechanism.

Figure 10A:
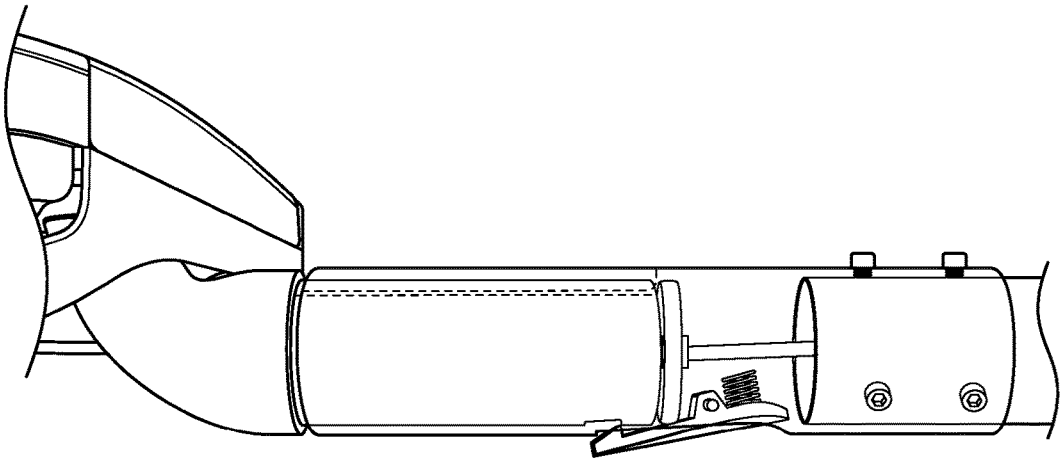
FIGS. 10A-C illustrate removing an exterior lighting assembly according to some embodiments.
Figure 10B:
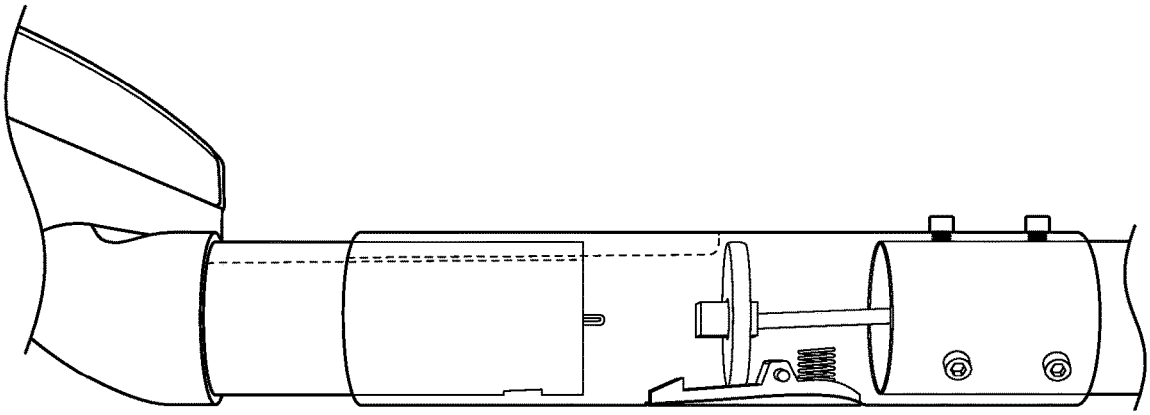
Figure 10C:
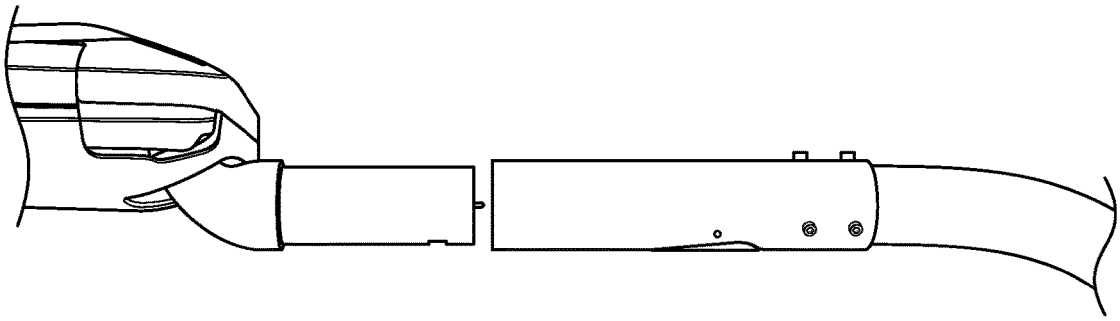

FIGS. 10A-C illustrate removing a light fixture assembly that is installed in a neck cuff. An individual presses the latch assembly to pivot the latch assembly into the open position (see FIG. 10A). The individual then slides the light fixture assembly out of the neck cuff and the individual may allow the latch assembly to return to the closed position (see FIG. 10B). The light fixture assembly is slid until it is completely removed from the neck cuff (see FIG. 10C). At this point, a new light fixture assembly may be installed, or the removed assembly may be repaired, refurbished, or adjusted while working on the ground. This makes it much easier and safer to install a new light fixture assembly or to repair/maintain an existing light fixture assembly.

Of course, the present invention is not limited to the above features and advantages. Those of ordinary skill in the art will recognize additional features and advantages upon reading the following detailed description, and upon viewing the accompanying drawings.

Notably, modifications and other embodiments of the disclosed invention(s) will come to mind to one skilled in the art having the benefit of the teachings presented in the foregoing descriptions and the associated drawings. Therefore, it is to be understood that the invention(s) is/are not to be limited to the specific embodiments disclosed and that modifications and other embodiments are intended to be included within the scope of this disclosure. Although specific terms may be employed herein, they are used in a generic and descriptive sense only and not for purposes of limitation.

What is claimed is:

1. A light fixture assembly configured for exterior lighting, comprising:

a light fixture, comprising:

a Light-Emitting Diode (LED) light source configured for exterior lighting;

a driver configured to power the LED light source;

a first electrical connector coupled to the driver; and a housing configured to house the LED light source and the driver, wherein the housing comprises an elongated extension about which the first electrical connector resides; and a neck cuff, wherein the neck cuff is configured to fit securely to a light pole, and wherein the neck cuff comprises a second electrical connector inside the neck cuff, the second electrical connector configured to electrically connect to a power source in the light pole, and wherein the elongated extension of the light fixture is configured to be inserted into the neck cuff such that the first electrical connector of the light fixture removably connects to the second electrical connector of the neck cuff, the electrical connection being inside the neck cuff; and wherein the neck cuff comprises an electrical receptacle on a side of the neck cuff, the electrical receptacle electrically connected to the power source in the light pole and configured to provide power to another light fixture.

2. The light fixture assembly of claim 1, wherein the second electrical connector is at least four inches deep into the neck cuff from a receiving end of the neck cuff.

3. The light fixture assembly of claim 1, wherein the first electrical connector is a female receptacle and the second electrical connector is a male plug.

4. The light fixture assembly of claim 1, wherein the first electrical connector is a male plug and the second electrical connector is a female receptacle.

5. The light fixture assembly of claim 1, further comprising;

a latching mechanism configured to secure the elongated extension of the light fixture to the neck cuff when the elongated extension is inserted into the neck cuff.

6. The light fixture assembly of claim 5, further comprising:

a pin attached inside the neck cuff, wherein the latching mechanism is mounted on the pin to pivot between on open position and a closed position in which the elongated extension of the light is secured to the neck cuff.

7. The light assembly of claim 6, further comprising:

an interior wall section of the neck cuff; and a spring, wherein the spring located between the interior wall section and a portion of the latching mechanism, wherein the spring forces the latching mechanism into the closed position.

8. The light assembly of claim 1, further comprising a guide portion located inside the neck cuff, wherein the guide portion is configured to align the elongated extension of the light fixture when the elongated extension is inserted into the neck cuff.

9. A method of replacing an old light fixture with a new light fixture, each of the old and new light fixtures comprising a Light-Emitting Diode (LED) light source configured for exterior lighting and an elongated extension on which a first electrical connector resides, the method comprising:

unsecuring the elongated extension of the old light fixture from a neck cuff secured to a light pole, wherein the neck cuff comprises a second electrical connector down inside the neck cuff, electrically connected to a power source in the light pole and removably connected to the first electrical connector on the elongated extension of the old light fixture;

removing the elongated extension of the old light fixture from inside the neck cuff, causing the first electrical connector of the old light fixture to disconnect from the second electrical connector of the neck cuff;

inserting the elongated extension of the new light fixture into the neck cuff until the first electrical connector of the new light fixture forms an electrical connection with the second electrical connector of the neck cuff;

securing the elongated extension of the new light fixture to the neck cuff; and plugging an electrical connector of another exterior light into a side receptacle of the neck cuff.

10. The method of replacing an old light fixture with a new light fixture of claim 9, wherein the inserting step further comprises aligning an orientation channel of the new light fixture with a guide disposed on an interior sidewall of the neck cuff.

11. A neck cuff configured to connect a light assembly to a light pole, the neck cuff comprising:

a body having a substantially cylindrical shape;

one or more holes configured to allow an attachment mechanism to secure the body to a light pole;

a quick connect electrical connector configured to be wired to a power source associated with the light pole and to connect to an electrical connector of a light assembly, wherein the quick connect electrical connector is located in an interior of the body; and a latching mechanism coupled to the body and configured to secure the light assembly in place when the light assembly is installed to the neck cuff.

12. The neck cuff of claim 11, wherein the electrical connector of the light fixture is a male plug and the quick connect electrical connector is a female receptacle.

13. The neck cuff of claim 11, wherein the electrical connector of the light fixture is a female receptacle and the quick connect electrical connector is a male plug.

14. The neck cuff of claim 11, further comprising:

a pin attached inside the neck cuff, wherein the latching mechanism is mounted on the pin to pivot between on open position and a closed position in which the elongated extension of the light assembly is secured to the neck cuff.

15. The neck cuff of claim 14, further comprising:

an interior wall section of the neck cuff; and a spring, wherein the spring located between the interior wall section and a portion of the latching mechanism, wherein the spring forces the latching mechanism into the closed position.

16. The neck cuff of claim 11, further comprising a guide portion located inside the neck cuff, wherein the guide portion is configured to align the elongated extension of the light assembly when the elongated extension is inserted into the neck cuff.

17. The neck cuff of claim 11, further comprising an electrical receptacle disposed on the outer sidewall of the body of the neck cuff.

18. The neck cuff of claim 11, wherein the quick connect electrical connector is disposed within the body at a position of 2 inches or greater from an opening on a light assembly end of the body of the neck cuff.

* * * * *